US011415015B2

(12) United States Patent
Fryer et al.

(10) Patent No.: US 11,415,015 B2
(45) Date of Patent: Aug. 16, 2022

(54) SLEEVE FOR OIL SERVICE TUBES

(71) Applicant: PRATT & WHITNEY CANADA CORP., Longueuil (CA)

(72) Inventors: Michael A. Fryer, Oakville (CA); Joe Lanzino, Meaford (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 142 days.

(21) Appl. No.: 16/661,512

(22) Filed: Oct. 23, 2019

(65) Prior Publication Data

US 2021/0123356 A1 Apr. 29, 2021

(51) Int. Cl.
*F01D 9/06* (2006.01)
*F01D 25/18* (2006.01)

(52) U.S. Cl.
CPC ..... *F01D 9/065* (2013.01); *F01D 25/18* (2013.01); *F05D 2220/32* (2013.01); *F05D 2260/98* (2013.01)

(58) Field of Classification Search
CPC . F01D 9/06; F01D 9/065; F01D 25/04; F01D 25/18; F02C 3/04; F02C 7/06; F05D 2220/32; F05D 2260/98; F05D 2240/14; F16L 3/00; F16L 5/00; F16L 7/00; F16L 57/00; F16L 59/00
See application file for complete search history.

(56) References Cited

U.S. PATENT DOCUMENTS

| | | | | |
|---|---|---|---|---|
| 3,060,069 | A * | 10/1962 | Sindars | F16L 59/022 138/120 |
| 3,490,746 | A | 1/1970 | Bell, III | |
| 4,288,109 | A * | 9/1981 | Ellis | F28F 9/185 285/141.1 |
| 6,357,222 | B1 | 3/2002 | Schilling et al. | |
| 7,451,541 | B2 | 11/2008 | Stastny et al. | |
| 8,083,940 | B2 | 12/2011 | Durocher et al. | |
| 8,596,959 | B2 | 12/2013 | Durocher et al. | |
| 9,765,648 | B2 | 9/2017 | Kullenberg | |
| 9,784,130 | B2 | 10/2017 | Brault | |
| 9,803,551 | B2 | 10/2017 | Hellgren et al. | |
| 2011/0036068 | A1* | 2/2011 | Lefebvre | F02K 1/80 60/262 |
| 2014/0010648 | A1 | 1/2014 | Muldoon | |
| 2015/0377065 | A1* | 12/2015 | Deane | F01D 9/065 285/15 |
| 2016/0341123 | A1* | 11/2016 | Socha | F01D 9/065 |
| 2017/0254540 | A1* | 9/2017 | DiCintio | F23R 3/283 |
| 2017/0292449 | A1* | 10/2017 | Agara | F01D 25/18 |
| 2017/0321572 | A1 | 11/2017 | Agara et al. | |
| 2018/0017259 | A1 | 1/2018 | Schiavo | |

(Continued)

FOREIGN PATENT DOCUMENTS

WO 2015013618 A1 1/2015

*Primary Examiner* — Loren C Edwards
(74) *Attorney, Agent, or Firm* — Norton Rose Fulbright Canada LLP

(57) ABSTRACT

An assembly for a gas turbine engine has a support structure and a tube configured to circulate lubricant and mounted to the support structure, a sacrificial sleeve extending around the tube and disposed between the support structure and the tube, the sacrificial sleeve welded to the support structure. A method of mounting a fluid carrying tube to a support structure in a gas turbine engine is provided.

19 Claims, 2 Drawing Sheets

(56) References Cited

U.S. PATENT DOCUMENTS

| | | | | |
|---|---|---|---|---|
| 2018/0223682 | A1* | 8/2018 | Hendrickson | F01D 25/18 |
| 2018/0274379 | A1 | 9/2018 | Karuppanchetty et al. | |
| 2019/0078464 | A1 | 3/2019 | Manteiga et al. | |

* cited by examiner

SLEEVE FOR OIL SERVICE TUBES

TECHNICAL FIELD

The application relates generally to gas turbine engines and, more particularly, to conduits used in such engines and configured for circulating fluid therethrough.

BACKGROUND

The lubrication system of a gas turbine engine includes a number of service tubes, which either feed lubricant (e.g. oil) to locations within the engine or scavenge the lubricant from such locations back to a storage tank. These service tubes are typically welded to supporting structures within the engine, such as support cones, which are fixed within an outer casing, for example. However, cracks can sometimes form, over time, within the welds formed between the support structures (e.g. support cones) and the service tubes. If left, these cracks can propagate through to the service tubes themselves. This is undesirable.

SUMMARY

In one aspect, there is provided an assembly for a gas turbine engine comprising a support structure and a tube configured to circulate lubricant and mounted to the support structure, a sacrificial sleeve extending around the tube and disposed between the support structure and the tube, the sacrificial sleeve welded to the support structure.

In another aspect, there is provided a gas turbine engine comprising the assembly of described above.

In yet another aspect, there is provided a method of mounting a fluid carrying tube to a support structure in a gas turbine engine, the method comprising: disposing a sacrificial sleeve around the fluid carrying tube; inserting the fluid carrying tube through the support structure such that the sacrificial sleeve is located between the structure and the fluid carrying tube; and welding the sacrificial sleeve to the structure.

BRIEF DESCRIPTION OF THE DRAWINGS

Reference is now made to the accompanying figures in which.

DETAILED DESCRIPTION

Figure 1:
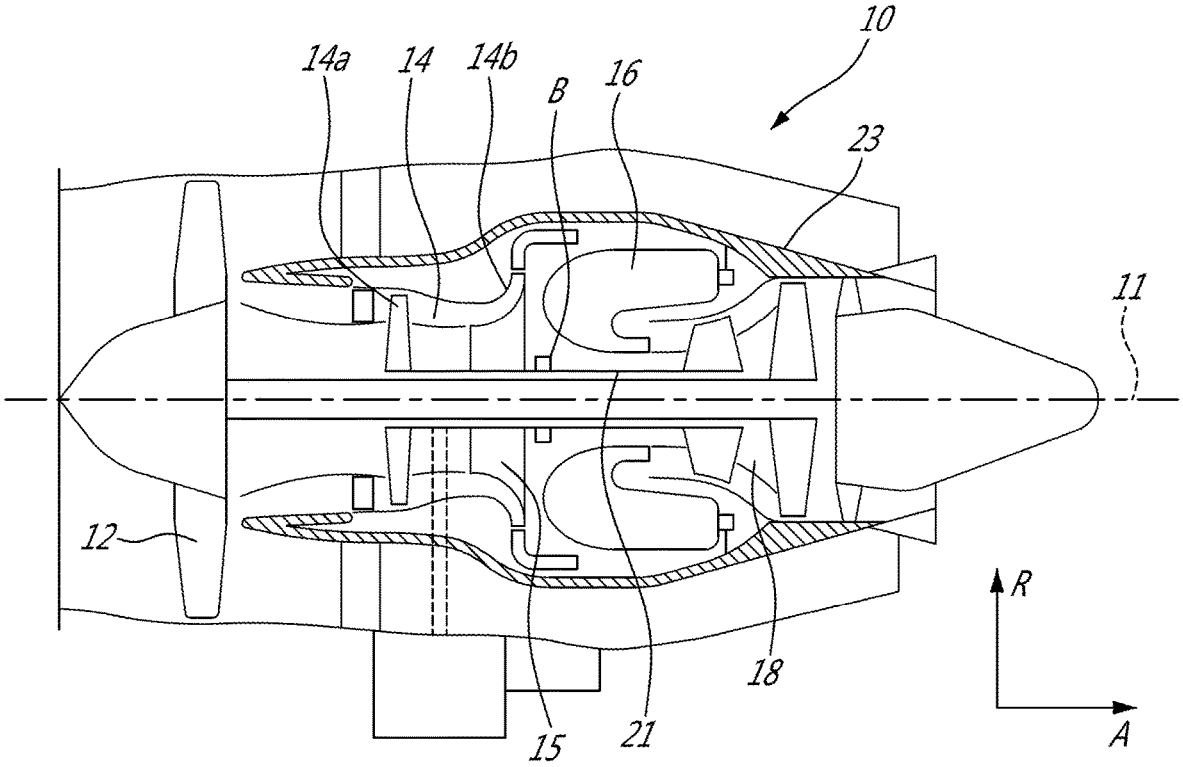
FIG. 1 is a schematic cross sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about a central axis 11 of the gas turbine engine 10.

Still referring to FIG. 1, the compressor section 14 includes a low pressure compressor 14*a* and a high pressure compressor 14*b*. The low pressure compressor 14*a* may be an axial compressor that includes a plurality of compressor stages each including a rotor and a stator. The high pressure compressor 14*b* is a centrifugal, or radial, compressor including an impeller 15 and a diffuser pipe assembly 20. The impeller 15 receives air that has been compressed by the low pressure compressor 14*a* along an axial direction A relative to the central axis 11. The impeller 15 includes a plurality of blades defining passages between two adjacent ones of the blades. The passages have each an inlet that is oriented substantially along the axial direction A and an outlet that is oriented substantially along a radial direction R relative to the central axis 11. The air from the low pressure compressor 14*a*, further to see its pressure increase via its circulation in the passages of the impeller 15, changes direction for being substantially axial to being substantially radial.

Figure 2:
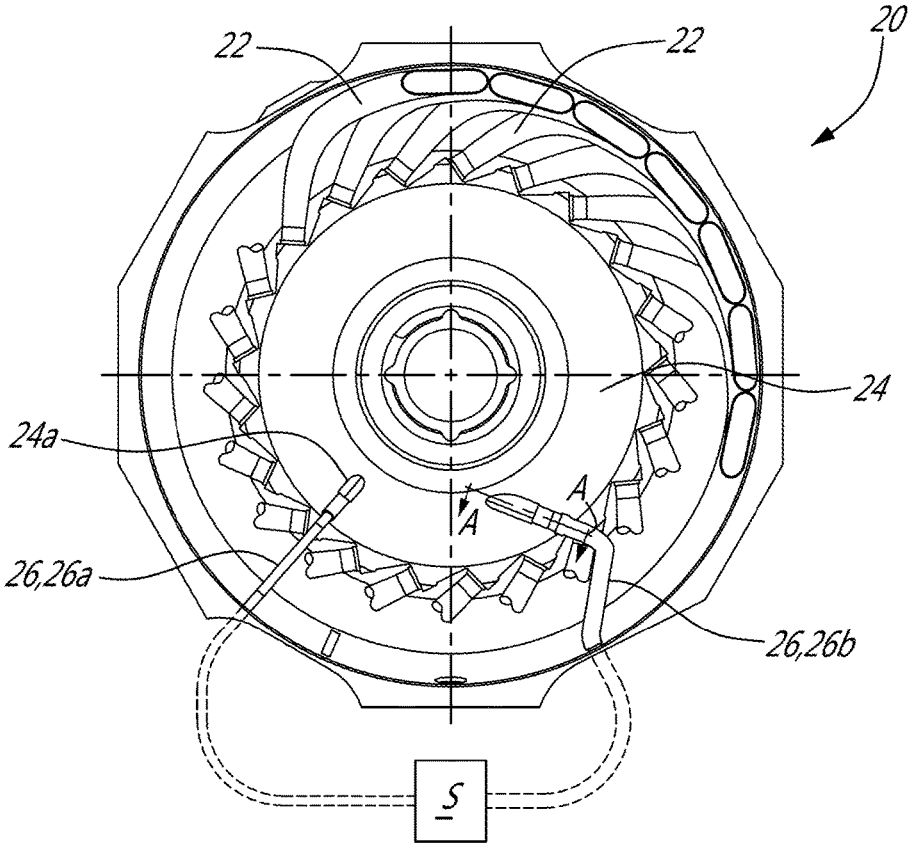
FIG. 2 is a schematic cross-sectional view of a diffuser case assembly of a compressor of the gas turbine engine of FIG. 1.

Referring now to FIG. 2, the diffuser pipe assembly 20 of the centrifugal compressor 14*b* is used for redirecting the flow of compressed air that exits the impeller 15 of the high pressure compressor 14*b* from being substantially radial to being substantially axial relative to the central axis 11. The diffuser pipe assembly 20 includes diffuser pipes 22 and a diffuser case, also referred to as a support cone, 24 on which the diffuser pipes 22 are secured. Each of the diffuser pipes 22 receives a portion of the flow, or a respective one of sub-flows, of compressed air from the impeller 15 and redirects it toward the combustor 16.

As shown in FIG. 2, service lines 26 extend through apertures 24*a* defined through the diffuser case 24. These service lines 26 may be used, for instance, to circulate lubricant from a source of lubricant to a bearing B located between a shaft 21 of the gas turbine engine 10 and a casing 23 thereof. In the embodiment shown, the service lines 26 includes an oil service tube-feed 26*a* and an oil service tube-scavenge 26*b*. The tube-feed 26*a* is used for circulating lubricant from a source of lubricant S to the bearing B whereas the tube-scavenge 26*b* is used for circulating the lubricant from the bearing B back to the source of lubricant S. In the embodiment shown, the service lines 26 are circular in cross-section, but it is understood that any other shape are contemplated.

The service lines 26 may be secured to the diffuser case 24 via a fillet weld. However, such a configuration may expose the service lines 26 to being breached should a crack from in the fillet weld and propagate into the service lines 26.

Figure 3:
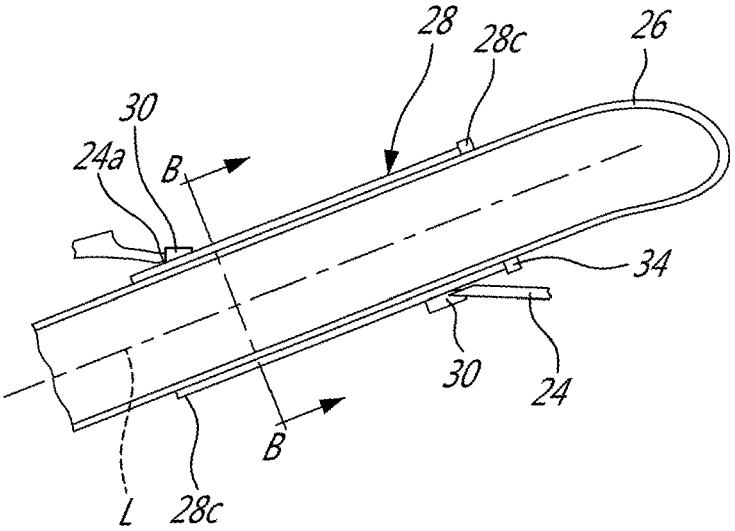
FIG. 3 is a schematic cross-sectional view taken along line A-A of FIG. 2.
Figure 4:
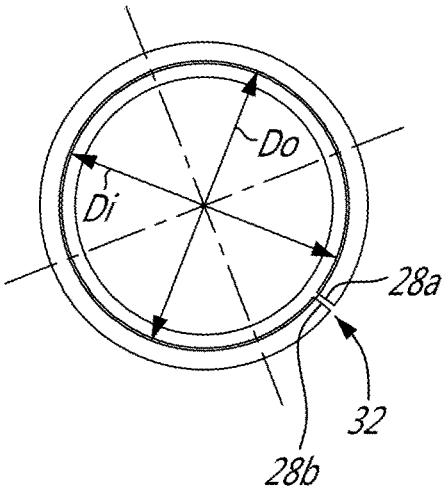
FIG. 4 is a schematic cross-sectional view taken along line B-B of FIG. 3.
Figure 5:
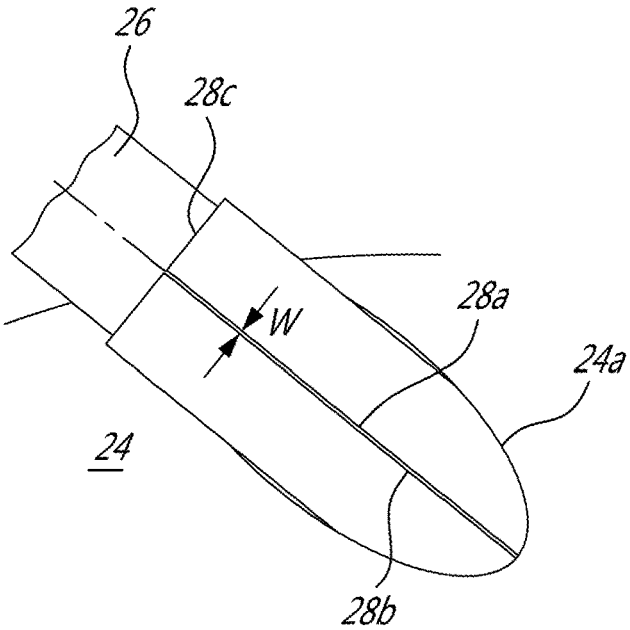
FIG. 5 is a schematic enlarged view of a portion of FIG. 2.

Referring to FIGS. 3-5, in the embodiment shown, a sleeve, also referred to as a sacrificial sleeve, 28 is disposed around the service tube 26 and is used for securing the service tube 26 to the case 24. The sleeve 28 is disposed radially between the line 26 and the case 24 relative to a longitudinal axis L of the line 26. The sleeve 28 may closely follow a shape of the tube 26. In other words, a cross-sectional area of the sleeve 28 at its inner face, which is oriented toward the tube 26, may substantially correspond to a shape of a cross-sectional area of the tube 26 at its outer face, which is oriented toward the sleeve 28. The service line 26 may be secured to the case 24 via the sleeve 28. In the embodiment shown, the sleeve 28 is secured to the case 24 via a weld joint, or fillet weld, 30. Any suitable way of securing the sleeve 28 to the case 24, such as brazing and soldering, may be used without departing from the scope of the present disclosure.

The sleeve 28 may be formed from existing tubing, that is from a same material of the service line 26, or, alternatively, may be formed from bar stock. The sleeve 28 may be made of a metallic material suitable for welding with the case 24, which may be metallic. The lines 26 may be made of a metallic material.

Referring more particularly to FIG. 4, the sleeve 28 extends circumferentially around the service line 26 but for a slot 32 defined in the sleeve 28. More specifically, the slot 32 extends circumferentially from a first edge 28*a* of the sleeve 28 to a second edge 28*b* of the sleeve 28. The slot 32 extends at least partially axially relative to the longitudinal axis L (FIG. 3) of the service line 26. The slot 32 may extend along an entirety of a length of the sleeve 28 taken along the longitudinal axis L. The slot 32 may extend both circumferentially and axially relative to the longitudinal axis L between opposed axial ends 28*c* of the sleeve 28.

The slot 32 may allow to provide a tight fit between the sleeve 28 and the service line 26. More specifically, an inner diameter Di of the sleeve 28 may be substantially the same as an outer diameter Do of the service line 26 prior to the sleeve 28 being disposed around the service line 26. The slot 32 may be used to allow the sleeve 28 to be wrapped around the service line 26. The length of the sleeve may be determined so that it fully protrudes on both sides of the cone (diaphragm) to allow for a fillet weld to be completed on both sides between the cone and the sleeve. The width W of the slot may be designed to be as small as possible.

Referring more particularly to FIG. 3, in the embodiment shown, the sleeve 28 is secured to the service line 26 at either one of its opposed axial ends 28*c*. In the embodiment shown, a weld joint, or fillet weld, 34 is used for securing the sleeve 28 to the service line 26. The fillet weld 34 may be replaced by brazing. Alternatively, the sleeve 28 may be simply disposed around the service line 26 without any further securement therebetween. In other words, the sleeve 28 and the service line 26 may be free of weld, braze, and/or soldering therebetween. The sleeve 28 and the service line 26 may be in a frictional engagement with one another.

In the depicted embodiment, the weld joint 30 between the case 24 and the sleeve 28 extends circumferentially around the sleeve 28 relative to the longitudinal axis L but for the slot 32. In other words, the slot 32 remains free of the weld joint 30. Stated differently, the service line 26 and the case 24 remain free of a weld joint therebetween. The weld joint 30 therefore starts at the axial slot 32 and ends at the slot 32. In other words, the weld joint 30 extends from the first edge 28*a* of the sleeve 28 toward the second edge 28*b* while avoiding the slot 32. The weld joint 30 does not bridge the slot 32. Such a configuration may prevent weld penetration through the service line 26.

Additive manufacturing or 3D printing could be employed for producing either the sleeve 28 or the sleeve 28 and the service line 26 together but configured with a discernable separation between the sleeve and line 26 to avoid a homogeneous structure or assembly. The sleeve 28 and the line 26 can be joined locally at one end similar to the weld 34.

The sleeve 28 may provide a barrier to protect the service line 26 from potential cracks that may initiate from the fillet weld 30 between the sleeve 28 and the case 24. The intent is for the crack to be arrested at, and confined to, the sleeve 28. In a particular embodiment, the sleeve 28 and the service line 26 are not bonded together by braze, solder or by fully welding. The proposed configuration may prevent potential cracks from breaching the service line inner or "wet wall".

For mounting the fluid carrying tube to the support structure, the sacrificial sleeve is disposed around the fluid carrying tube; the fluid carrying tube is inserted through the support structure such that the sacrificial sleeve is located between the structure and the fluid carrying tube; and the sacrificial sleeve is welded to the structure.

In the embodiment shown, disposing the sacrificial sleeve around the fluid carrying tube before the fluid carrying tube is inserted through the support structure. Welding the sacrificial sleeve to the structure may include disposing a weld joint around the sacrificial sleeve and leaving a slot of the sacrificial sleeve longitudinally extending along a length of the sacrificial sleeve free of the weld joint. In the present embodiment, disposing the sacrificial sleeve around the fluid carrying tube includes: increasing a width of a slot of the sacrificial sleeve until the width is greater than an outer diameter of the fluid carrying tube; inserting the fluid carrying tube within the sacrificial sleeve via the slot; and tightening the sacrificial sleeve around the fluid carrying tube.

In the depicted embodiment, tightening the sacrificial sleeve includes releasing edges of the sacrificial sleeve. In the present embodiment, mounting the tube to the structure further includes securing the sacrificial sleeve to the fluid carrying tube solely at one of opposed axial ends of the fluid carrying tube. Securing the sacrificial sleeve to the fluid carrying tube may include welding the sacrificial sleeve to the fluid carrying tube at the one of the opposed axial ends. Tightening the sacrificial sleeve around the fluid carrying tube may include decreasing a width of the slot.

Embodiments disclosed herein include:

A. An assembly for a gas turbine engine comprising a support structure and a tube configured to circulate lubricant and mounted to the support structure, a sacrificial sleeve extending around the tube and disposed between the support structure and the tube, the sacrificial sleeve welded to the support structure.

B. A gas turbine engine comprising the assembly of embodiment A.

Embodiments A and B may include any of the following elements, in any combinations:

Element 1: the sacrificial sleeve is welded to the support structure via a fillet weld. Element 2: the sacrificial sleeve extends circumferentially around the tube relative to a longitudinal axis of the tube but for a slot. Element 3: the slot extends axially from a first axial end of the sacrificial sleeve to a second axial end of the sacrificial sleeve opposite the first axial end. Element 4: the sacrificial sleeve is secured to the tube solely at one of axial ends of the sacrificial sleeve, the other of the axial ends of the sacrificial sleeve free of securement between the sacrificial sleeve and the tube. Element 5: a fillet weld secures the sacrificial sleeve to the tube at the one of the axial ends. Element 6: the sacrificial sleeve protrudes on both sides of the support structure. Element 7: the sacrificial sleeve is secured to the support structure on both sides thereof via fillet welds. Element 8: an inner diameter of the sacrificial sleeve is less than an outer diameter of the tube before the sacrificial sleeve is disposed around the tub such that a tight fit is provided between the sacrificial sleeve and the tube. Element 9: the sacrificial sleeve extends circumferentially around the tube relative to a longitudinal axis of the tube but for a slot, the sacrificial sleeve welded to the structure via a fillet weld, the slot free of the fillet weld. Element 10: the sacrificial sleeve extends circumferentially around the tube relative to a longitudinal axis of the tube but for a slot, the sacrificial sleeve welded to the structure via a fillet weld, the slot free of the fillet weld.

C. A method of mounting a fluid carrying tube to a support structure in a gas turbine engine, the method comprising: disposing a sacrificial sleeve around the fluid carrying tube; inserting the fluid carrying tube through the support structure such that the sacrificial sleeve is located between the structure and the fluid carrying tube; and welding the sacrificial sleeve to the structure.

Embodiment C may include any of the following elements, in any combinations:

Element 11: disposing the sacrificial sleeve around the fluid carrying tube before the fluid carrying tube is inserted through the support structure. Element 12: welding the sacrificial sleeve to the structure includes disposing a weld joint around the sacrificial sleeve and leaving a slot of the sacrificial sleeve longitudinally extending along a length of the sacrificial sleeve free of the weld joint. Element 13: disposing the sacrificial sleeve around the fluid carrying tube includes: increasing a width of a slot of the sacrificial sleeve until the width is greater than an outer diameter of the fluid carrying tube; inserting the fluid carrying tube within the sacrificial sleeve via the slot; and tightening the sacrificial sleeve around the fluid carrying tube. Element 14: tightening the sacrificial sleeve includes releasing edges of the sacrificial sleeve. Element 15: further comprising securing the sacrificial sleeve to the fluid carrying tube solely at one of opposed axial ends of the fluid carrying tube. Element 16: securing the sacrificial sleeve to the fluid carrying tube includes welding the sacrificial sleeve to the fluid carrying tube at the one of the opposed axial ends. Element 17: tightening the sacrificial sleeve around the fluid carrying tube includes decreasing a width of the slot.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. An assembly for a gas turbine engine comprising a support structure and a tube configured to circulate lubricant and mounted to the support structure, a sacrificial sleeve extending around the tube and disposed between the support structure and the tube, the sacrificial sleeve welded to the support structure, the sacrificial sleeve extending circumferentially around the tube relative to a longitudinal axis of the tube but for a slot, the sacrificed sleeve having a total length defined between a first axial end and a second axial end opposite the first axial end, a shape of the sacrificial sleeve matching a shape of the tube along a major portion of the total length of the sacrificial sleeve defined between the first axial end and the second axial end.

2. The assembly of claim 1, wherein the sacrificial sleeve is welded to the support structure via a fillet weld.

3. The assembly of claim 1, wherein the slot extends axially from the first axial end of the sacrificial sleeve to the second axial end of the sacrificial sleeve opposite the first axial end.

4. The assembly of claim 1, wherein the sacrificial sleeve is secured to the tube solely at the first axial end of the sacrificial sleeve, the second axial end of the sacrificial sleeve being free of securement between the sacrificial sleeve and the tube.

5. The assembly of claim 4, wherein a fillet weld secures the sacrificial sleeve to the tube at the axial end.

6. The assembly of claim 1, wherein the sacrificial sleeve protrudes on both sides of the support structure.

7. The assembly of claim 1, wherein the sacrificial sleeve is secured to the support structure on both sides of the support structure via fillet welds.

8. The assembly of claim 1, wherein an inner diameter of the sacrificial sleeve is less than an outer diameter of the tube before the sacrificial sleeve is disposed around the tube such that a tight fit is provided between the sacrificial sleeve and the tube.

9. The assembly of claim 1, wherein the sacrificial sleeve is welded to the support structure via a fillet weld, the slot being free of the fillet weld.

10. A gas turbine engine comprising the assembly of claim 1.

11. The gas turbine engine of claim 10, wherein the sacrificial sleeve is welded to the support structure via a fillet weld, the slot being free of the fillet weld.

12. A method of mounting a fluid carrying tube to a support structure in a gas turbine engine, the method comprising:

disposing a sacrificial sleeve around the fluid carrying tube, the sacrificial sleeve extending circumferentially around the fluid carrying tube relative to a longitudinal axis of the fluid carrying tube but for a slot, the sacrificed sleeve having a total length defined between a first axial end and a second axial end opposite the first axial end, a shape of the sacrificial sleeve matching a shape of the tube along a major portion of the total length of the sacrificial sleeve;

inserting the fluid carrying tube through the support structure such that the sacrificial sleeve is located between the support structure and the fluid carrying tube; and welding the sacrificial sleeve to the support structure.

13. The method of claim 12, comprising disposing the sacrificial sleeve around the fluid carrying tube before the fluid carrying tube is inserted through the support structure.

14. The method of claim 12, wherein welding the sacrificial sleeve to the support structure includes disposing a weld joint around the sacrificial sleeve and leaving the slot of the sacrificial sleeve longitudinally extending along the total length of the sacrificial sleeve free of the weld joint.

15. The method of claim 12, wherein disposing the sacrificial sleeve around the fluid carrying tube includes:

increasing a width of the slot of the sacrificial sleeve until the width is greater than an outer diameter of the fluid carrying tube;

inserting the fluid carrying tube within the sacrificial sleeve via the slot; and tightening the sacrificial sleeve around the fluid carrying tube.

16. The method of claim 15, wherein tightening the sacrificial sleeve includes releasing edges of the sacrificial sleeve.

17. The method of claim 15, wherein tightening the sacrificial sleeve around the fluid carrying tube includes decreasing the width of the slot.

18. The method of claim 12, further comprising securing the sacrificial sleeve to the fluid carrying tube solely at the first axial end of the sacrificial sleeve.

19. The method of claim 18, wherein securing the sacrificial sleeve to the fluid carrying tube includes welding the sacrificial sleeve to the fluid carrying tube at the first axial ends.

* * * * *